United States Patent [19]

Strider

[11] Patent Number: 4,862,186

[45] Date of Patent: Aug. 29, 1989

[54] MICROWAVE ANTENNA ARRAY WAVEGUIDE ASSEMBLY

[75] Inventor: Charles A. Strider, Los Angeles, Calif.

[73] Assignee: Hughes Aircraft Company, Los Angeles, Calif.

[21] Appl. No.: 929,566

[22] Filed: Nov. 12, 1986

[51] Int. Cl.[4] ..... H01Q 13/00

[52] U.S. Cl. ..... 343/776; 333/137; 333/239

[58] Field of Search ..... 343/776, 786; 333/137, 333/239, 242, 248

[56] References Cited

U.S. PATENT DOCUMENTS

| | | | |
|---|---|---|---|
| 3,157,847 | 11/1964 | Williams | 333/239 |
| 3,315,187 | 4/1967 | Nakahara et al. | 333/239 |
| 3,505,730 | 4/1970 | Nelson | 333/242 |
| 3,720,890 | 3/1973 | Anderson | 333/248 |
| 3,727,152 | 10/1973 | Bodonyi | 333/6 |
| 3,801,939 | 4/1974 | Lamy et al. | 333/239 |
| 4,020,875 | 5/1977 | Akiba | 333/239 |
| 4,623,894 | 11/1986 | Lee et al. | 343/776 |

FOREIGN PATENT DOCUMENTS

| | | | |
|---|---|---|---|
| 0060762 | 9/1982 | European Pat. Off. . | |
| 1047897 | 8/1952 | Fed. Rep. of Germany | 333/239 |
| 1346490 | 11/1963 | France | 333/239 |
| 585290 | 1/1945 | United Kingdom | 333/239 |
| 758457 | 10/1956 | United Kingdom | 333/239 |
| 2143681 | 2/1985 | United Kingdom . | |

OTHER PUBLICATIONS

Conference Proceedings of the 16th European Microwave Conference, 8–12 Sep. 1986, Dublin, Ireland, Microwave Exhibitions and Publishers Ltd, (Tunbridge Wells, Kent, GB), F. Rispoli et al.: "High Performance Beam Forming Network for Multi Contoured Beam Antennas", pp. 369–374.

Patent Abstracts of Japan, vol. 10, No. 268 (E–436) (2324), 12 Sep. 1986, and JP, A, 6192002 (Koden Electronics Co. Ltd.) 10 May 1986.

Soviet Inventions Illustrated, Derwent Publications Ltd. (London, GB), and SU, A, 176964 (I. A. Grigoryev) 1 Dec. 1965.

*Primary Examiner*—Rolf Hille

*Assistant Examiner*—Hoanganh Le

*Attorney, Agent, or Firm*—Leonard A. Alkov

[57] ABSTRACT

Close tolerance waveguide assemblies for use in antenna arrays is disclosed. In particular, the waveguide assemblies are configured along the zero electrical current lines in the antenna array. Such waveguides are particularly useful in antenna arrays for radar systems operating at the microwave and millimeter-wave frequencies. In the invention, antenna array assemblies, such as rectangular or ridged waveguide assemblies, are configured by combining plates which are formed into a plurality of equal length members protruding from and perpendicularly disposed to a structural member, wherein each such protruding member has two formed or unformed ends.

52 Claims, 4 Drawing Sheets

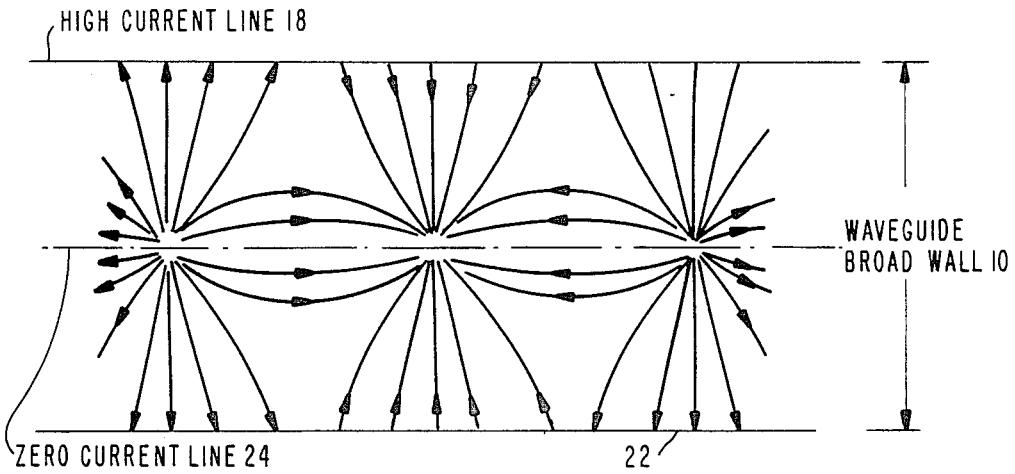
Fig. 1a.
Fig. 1b.
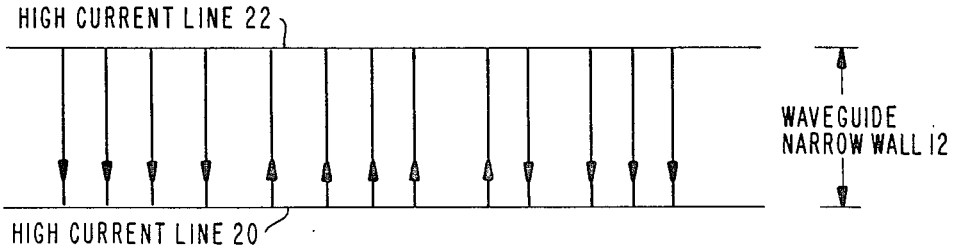

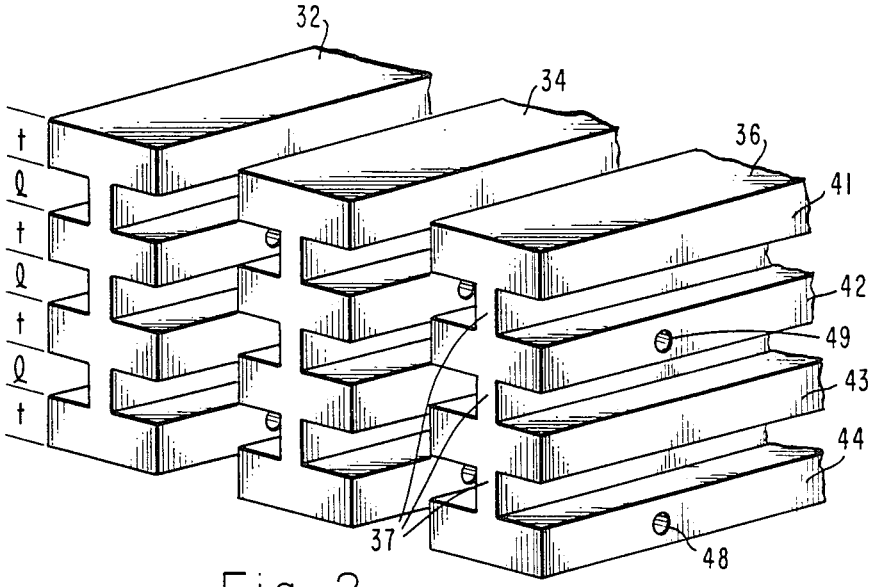
Fig. 2.
Fig. 3.
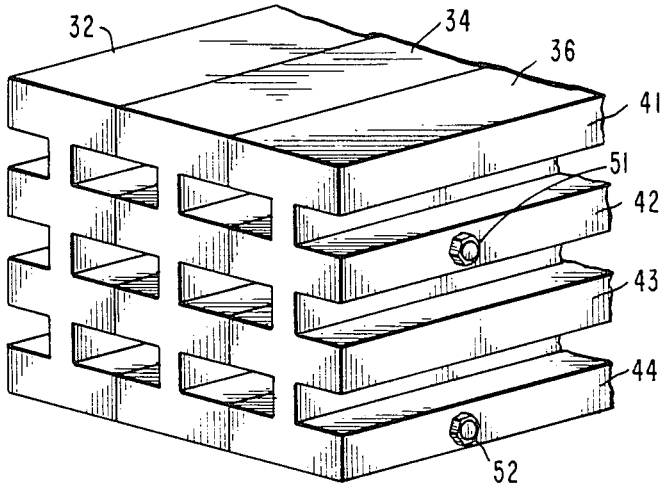

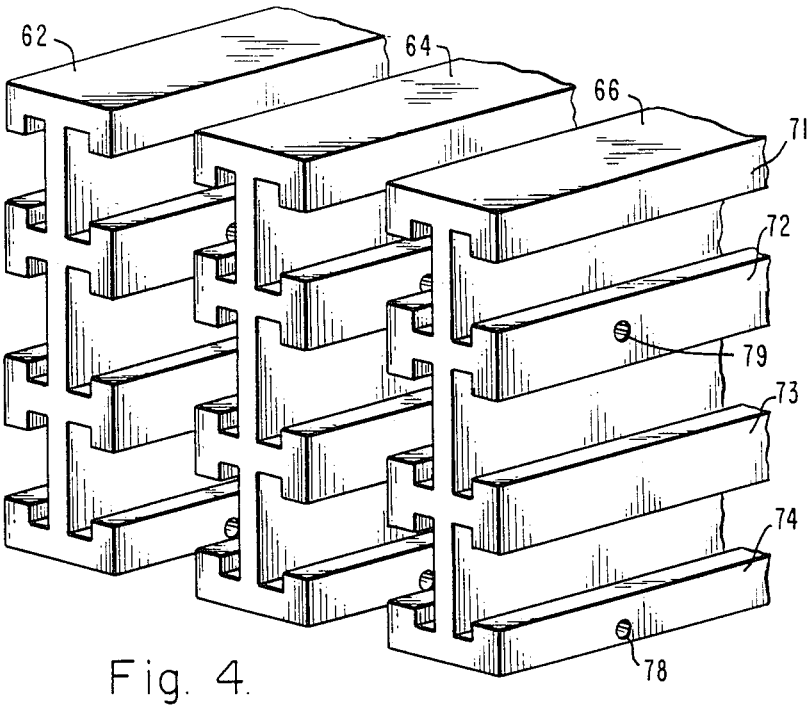
Fig. 4.
Fig. 5.
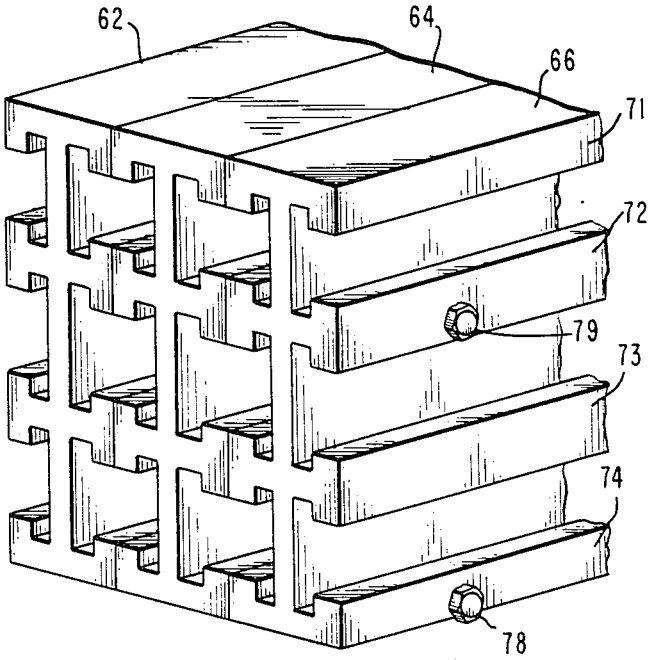

MICROWAVE ANTENNA ARRAY WAVEGUIDE ASSEMBLY

BACKGROUND OF THE INVENTION

The invention relates to close tolerance waveguide assemblies used in antenna arrays and particularly to the configuration of such assemblies along zero electrical current lines in the antenna arrays.

In the construction of antenna array waveguide assemblies, especially those which are used with systems that operate at microwave and millimeter frequencies, it is desirable to form a series of waveguides to achieve precision antenna aperture control. As the operating frequency of a system incorporating the antenna array increases, the tolerance control, or precision, required of the antenna array assembly becomes significantly more difficult to achieve.

Antenna array waveguide assemblies are conventionally constructed by brazing, welding or bonding a series of waveguides into an array assembly. An example of this method of construction is the electronically steered antenna for United States Air Force B-1 aircraft. In general, tolerance accumulation results in poor yield, particularly at microwave and millimeter-wave frequencies. Another method of construction is the machining of plates of metal, stacking these plates to form the array assembly and then brazing, welding or bonding the joints into a finished structural antenna. An example of the use of this technique is the radar antenna used in the TORNADO Euroepan fighter aircraft jointly produced by West Germany, Italy and the United Kingdom. In the use of this construction technique, the separation of the piece parts of the waveguide occurs along regions of high electrical current density, so as to require a continuous weld, braze or conductive bond to provide electrical conductivity. In the process of welding and brazing, significant heating of the hardware to near melting temperatures is involved resulting in physical distortion and poor electrical performance of the antenna array. Conductive bonds are generally structurally inadequate and when combined with structural adhesives the desired array dimensions cannot be achieved without great difficulty, particularly at higher system operating frequencies.

General antenna theory pertaining to the background of the present invention is discussed in Chapter 7 of Microwave Antenna Theory and Design, Massachusetts Institute of Technology Radiation Laboratory Series (Vol. 12), Louis N. Ridenour, Editor-in-Chief, Edited by Samuel Silver, McGraw-Hill Book Company, Inc., 1949 and Chapter 2 of Waveguide Handbook, Massachusetts Institute of Technology Radiation Laboratory Series (Vol. 10), edited by N. Marcuvitz, McGraw-Hill Book Company, Inc., 1951.

The present invention eliminates the need for welding or brazing altogether, so that such problems do not arise. In the present invention, antenna array assemblies, such as rectangular or ridged waveguide configured assemblies, are constructed by combining plates which are formed into a plurality of equal length members (the broadwalls of the resulting waveguide assembly), protruding from and perpendicularly disposed to a structural member (the narrow wall of the resulting waveguide assembly), wherein each such protruding member has two unformed or formed ends. Each such plate, therefore, constitutes a plurality of half-waveguide assemblies. The plates are generally composed of some metal or metal alloy, but could be composed of other materials or combinations of materials, including treated or metallized plastics. The plates are combined by matching each of the ends of the plurality of protruding members of one plate to the corresponding ends of the (equal number of) plurality of protruding members of the other plates. By bringing together the plates in this manner, the narrow walls of the waveguide assemblies are formed, so that the half-waveguide openings in each part of the waveguide assembly are aligned with the openings in the matching part of another waveguide assembly to form complete waveguides, which is thus a complete waveguide assembly for use in an antenna array. This alignment occurs at precisely the line where there is zero electrical current in the broadwall of the antenna waveguide assembly so that electrical conductivity is at the juncture of the half-waveguide assemblies not required. The waveguide assemblies must be held together. For example, a small number of metal bolts are used to hold the plates in an assembly with the bolts passing horizontally between waveguide channels. The dividing line of the plates is selected to be the center line of the waveguide channels where no electrical currents exist. Consequently, no welding, brazing or bonding is required. The bolts are used to compress the accurately machined plates into a precision array assembly which is free of distortion and dimensional errors and displays excellent antenna microwave and millimeter-wave frequency performance. The manufacturing yield for the inventive assembly approaches one hundred percent in contrast to the fifty-percent yield when the brazing, welding or bonding process is employed in the construction.

SUMMARY OF THE INVENTION

It is therefore an object of the invention to provide an antenna array waveguide assembly which is constructed so as to eliminate the need for brazing, welding or bonding so as to result in a higher manufacturing yield.

Another object of the invention is to construct the waveguide assembly along the center line of waveguide channels where there is no electrical current.

The invention is directed to a close tolerance antenna array waveguide assembly used in antenna arrays having half-waveguides with zero electrical current lines. The invention uses mechanical means for combining half-waveguides of antenna arrays thereby eliminating the need for applying heat to the waveguides. The invention produces a high manufacturing yield in contrast to conventional waveguide assemblies which are produced by brazing, welding or bonding.

One embodiment of the waveguide assembly employs a first plate with a vertical structural member and a second plate with a vertical structural member for use in antenna arrays having half-waveguides with a zero electrical current line along the center of the waveguide assembly with (a) the first plate consisting of a plurality of matching protruding equal-length members perpendicularly disposed to said structural member of said first plate each said protruding member having two ends, (b) the second plate consisting of a plurality of protruding equal-length members perpendicularly disposed to said structural member of said second plate each said protruding member having two ends, (c) the first plate in juxtaposition with said second plate so that each of said ends of each of said plurality of matching protruding members in said first plate is aligned with each of said ends of said corresponding plurality of matching said ends of said protruding members in said second plate whereby said zero electrical curret line exists at the junction of each of said ends, and (d) a means for holding said first plate and said second plate together.

BRIEF DESCRIPTION OF THE DRAWINGS

With the above summary and objects in view, this invention consists of the details of construction and combination of parts as will be more fully understood from the detailed description when read in conjunction with the accompanying drawings as follows:

FIG. 1 is an illustration of electrical current density and flow at the broadwall and narrrowwall of a waveguide assembly;

FIG. 2 is an exploded view of a series of metal plates (half-waveguides) having protruding members to be combined to form an antenna waveguide assembly;

FIG. 3 is a perspective view of an assembled waveguide assembly illustrating the bolting mechanism;

FIG. 4 is an exploded view of another series of metal plates (half-waveguides) having protruding members with T-shaped ends to be combined to form a double-ridged antenna waveguide assembly;

FIG. 5 is a perspective view of an assembled double-ridged wavguide assembly of the invention.

DETAILED DESCRIPTION OF THE PREFERRED EMBODIMENTS

Figure 6:
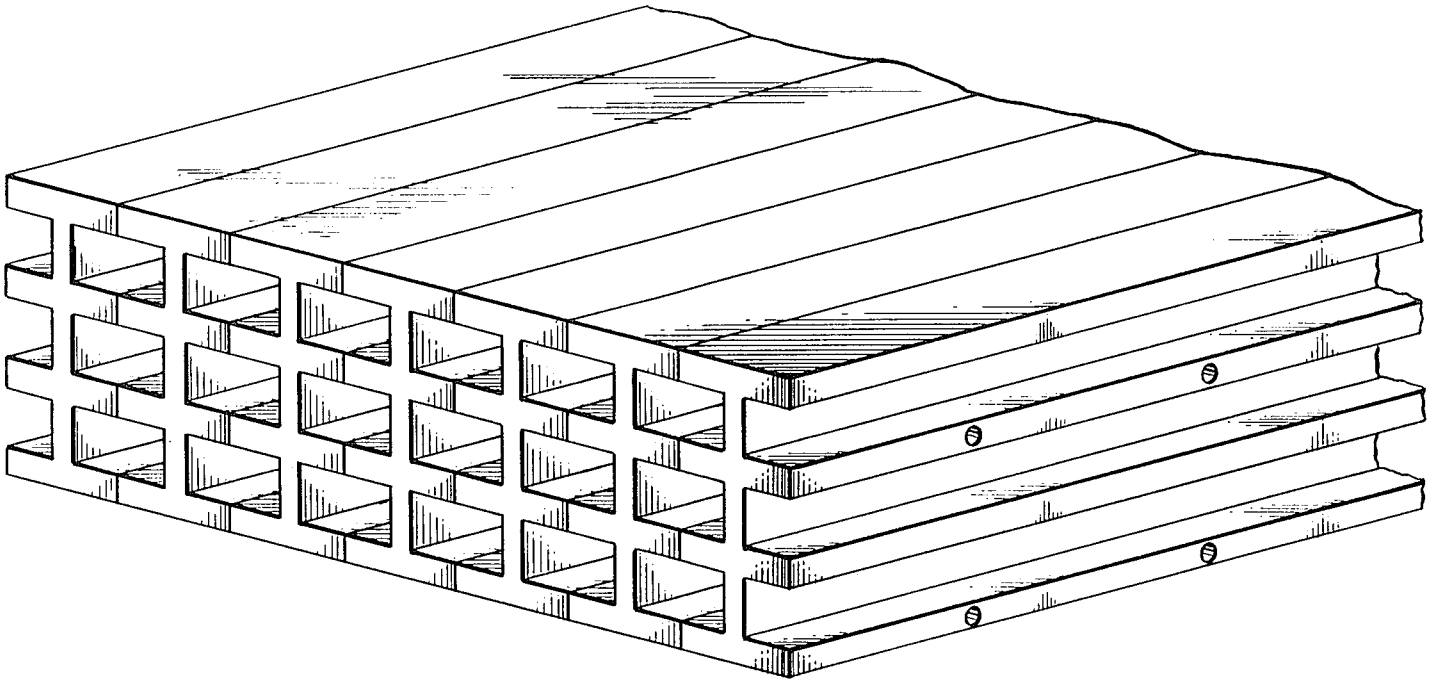
FIG. 6 illustrates a planar-surface antenna array composed of rectangular waveguide assemblies.

FIG. 1 shows the electrical current distribution and flow at the broadwall (FIG. 1*a*) and at the narrow-wall (FIG. 1*b*) of a rectangular waveguide. The waveguide consists of broadwall 10 and narrow-wall 12. Electrical current distribution within the waveguide is indicated by current density lines with arrows indicating the direction of electron movement. High current lines 18 and 22 are at the ends of the broadwall of the waveguide and high current lines 20 and 22 are at the ends of the narrow-wall of the waveguide. Zero current line 24 which is essential to the inventive concept and critical to the embodiment of the invention is at the center of waveguide broadwall 10, equal distant from high current line 18 and high current line 22. As will be shown, the invention is implemented such that the dividing line of metal plates used to construct the waveguide are selected to be the center line of the waveguide channels where no electrical current (zero current line in FIG. 1) exists, so that no welding, brazing or bonding is required to construct the waveguide assembly, because electrical conductivity at that line is not necessary.

FIG. 2 is an exploded view of three metal plates (32, 34, 36) each having horizontal members to be combined to form an antenna waveguide assembly. In this embodiment, each metal plate (32, 34, 36) has four protruding members perpendicularly disposed to a structural member 37, as shown by members (41, 42, 43, 44) of plate 36. Each metal plate (32, 34, 36) is similarly constructed, having an equal number of some plurality of protruding members. As shown in FIG. 2, the protruding members are of equal thickness t for each of the metal plates (32, 34, 36) and are also equally spaced apart by 1 for each of the metal plates (32, 34, 36). However, for purposes of construction and operation of the invention, such thickness and spacing measurements may vary. It is required that such thickness and spacing be substantially identical for each of the metal plates (32, 34, 36), so that when the plates (32, 34, 36) are placed together, each of the horizontal members (41, 42, 43, 44) will be in juxtaposition.

FIG. 2 also illustrates that each member (32, 34, 36) has cavities running through some of the protruding members. These are illustrated as cylindrical holes throughout the centers of two protruding members (42, 44) of each of the metal plates (32, 34, 36) and specifically as holes 48 and 49 in protruding members 44 and 42, respectively, of plate 36. Metal bolts (51, 52) are placed through each of the holes of each of the members (42, 44) having such holes (48, 49) bolt the plates together to form the waveguide assembly. Although only two cylindrical cavities (48, 49) are shown in FIG. 2 for each metal plate (32, 34, 36), one for each bolt, other embodiments could have additional such cavities depending on the number of protruding members per plate and the desired strength of the waveguide assembly. In one embodiment of the present invention 256 such bolts are used. Moreover, it is possible to use other forms of mechanical means to join the plates.

In practice, metal plates (32, 34, 36) are formed by the machining of unformed metal plates so as to produce protruding members (41, 42, 43, 44), such that columns of half-waveguide openings are created. Precision tooling exists in the art to produce finely machined, close tolerance, metal plates (32, 34, 36) such that measurements t and 1 are precisely controlled. In particular, Automated Numerically Controlled Machine model No. MC1000VS made by Matsuura Company of Japan is available on the market for such precision machining. Two such metal sheets (34, 36) are brought together such that the half-waveguide openings in each sheet are aligned with the half-waveguide openings in the second sheet to form a plurality of complete waveguides. A relatively small number of metal bolts is used to hold the metal plates in an assembly with the bolts passing horizontally between waveguide channels. The dividing line of the metal plates is selected to be the centerline of the waveguide channels, where no electrical current exists (zero current line 24 of FIG. 1). Consequently, welding, brazing or bonding is not required in conventional antenna waveguides.

The plates may be composed of such common metals as aluminum, magnesium, and copper, or metal alloys, such as steel. It is also possible for other compositions of matter to be used such as metallized plastics, which is a metal-plated plastic configured by plating the plastic with metal or by vapor deposition plating.

FIG. 3 illustrates specifically how metal plates (32, 34, 36) are brought together to form the waveguide assembly. Only three such metal plates are brought together in FIG. 3; however, a plurality of many more such plates may be brought together to form a larger waveguide assembly, and ultimately to form an entire antenna array.

FIG. 3 demonstrates how the protruding members with unformed ends of each of the metal plates (32, 34, 36) are placed in juxtaposition forming complete waveguide channels for the waveguide assembly. As described above, the waveguide channels are connected at the zero current lines as discussed in reference to FIG. 1. FIG. 3 shows six complete waveguide channels being connected by the placement of the metal sheets (32, 34, 36) together. Bolts (51 and 52) are used as shown in FIG. 3 to maintain the metal sheets (32, 34, 36) together, in the manner discussed above with reference to FIG. 2.

Consequently, there is no need for brazing or welding the half-waveguide sections to form the full or complete waveguide channels.

In the same manner as described above, a large number of waveguide assemblies can be placed together by placement of metal plates in juxtaposition. Bolts or some other mechanical means can be used to hold the metal sheets together. Consequently a large planar array antenna can be formed.

FIG. 4 is an exploded view of another set of three metal plates (62, 64, 66) each having members comprised of protruding members with end components forming "L" or "T" shape slot protruding members to illustrate another embodiment of the invention. The plurality of the protruding interior waveguide members (72, 73) are thus formed in a "T" shape and the two protruding exterior waveguide members (71 and 74) are formed in an "L" shape. When the three plates are combined, double-ridged waveguide channels are formed for the configuration of metal plates (62, 64, 66) illustrated in FIG. 4. Double-ridge waveguides are particularly desirable for microwave and millimeter wavelength applications, as for use in operating radar systems. In particular, in the embodiment shown in FIG. 4, each metal plate (62, 64, 66) has four protruding members as shown by members (71, 72, 73, 74) of plate 66. Protruding member 71 of plate 66 is in an "L" shape because of a perpendicularly disposed end member. Protruding members 72 and 73 are in the shape of a "T". Finally, protruding member 74 of plate 66 is in an "L" shape, as is protruding element 71. Each metal plate (62, 64, 66) is similarly constructed, having an equal number of some plurality of protruding members. As shown in FIG. 4, the protruding members are of equal thickness t for each of the metal plates (62, 64, 66) and are equally spaced apart by 1. The "L" shapes are similarly configured for each of the metal plates (62, 64, 66) and the "T" shape for the protruding members are also similarly configured for each of the metal plates (62, 64, 66). However, for purposes of construction and operation of the invention, such thickness and spacing measurements may vary. It is required that such thickness and spacing be substantially identical for each of the metal plates (62, 64, 66), so that when the plates (62, 64, 66) are placed together, each of the protruding members (71, 72, 73, 74) will be in juxtaposition.

FIG. 4 further illustrates that each member (62, 64, 66) has cavities running through some of the protruding members. These are illustrated as cylindrical holes throughout the centers of two protruding members (72, 74) of each of the metal plates (62, 64, 66) and specifically as holes 78 and 79 in protruding members 64 and 62 respectively of plate 66. Metal bolts are placed through each of the holes of each of the members (62, 64) having such holes (78, 79) hold the plates together to form the double-ridged waveguide assembly together. Although only two cylindrical cavities (78, 79) are shown in FIG. 4 for each metal plate (62, 64, 66), other embodiments could have additional such cavities depending on the number of protruding members per plate and the desired strength of the waveguide assembly. It is also possible to use other forms of mechanical means to join the plates.

FIG. 5 shows how the protruding members of each of the metal plates (62, 64, 66) are placed in juxtaposition forming complete waveguide channels for the waveguide assembly. The waveguide channels are connected at the zero current lines. FIG. 5 shows six complete waveguide channels being connected by the placement of the metal sheets (62, 64, 66) together. Bolts (72 and 78) are used as shown in FIG. 5 to maintain the metal sheets (62, 64, 66) together.

Antenna assemblies with different geometrical configurations may be constructed with other than rectangular waveguides, as illustrated in FIG. 2, and double-ridged waveguides, as illustrated in FIG. 4, such as square, triangular, circular, oval, and the like. The half-waveguides can be produced with such geometrical shapes to form the waveguide assemblies.

In operation, a series of waveguide assemblies are formed together to construct an antenna array or aperture for use in energy systems, and in particular, those systems which operate at microwave or millimeterwave frequency. FIG. 6 illustrates a planar-surface antenna array composed of a series of rectangular waveguide assemblies of the kind described in FIG. 3. The size of such an array, and the number of waveguide channels or slots depends on the construction of the metal plates and the number of waveguide channels desired for the operating system for which the antenna is required. Such antenna arrays are particularly useful in connection with radar and communications systems, specifically for microwave and millimeterwavelength frequency operation systems.

The described embodiments of the invention are only considered to be preferred and illustrative of the inventive concept; the scope of the invention is not to be restricted to such embodiment. Various and numerous other arrangements may be devised by one skilled in the art without departing from the spirit and scope of this invention. For example, other geometrical configurations for the waveguide assemblies than rectangular or doubleridged configurations are possible and may be desirable depending upon the system operation wavelengths desired. Moreover, other compositions of matter may be employed rather than metal or metallized plastic. Furthermore, other than a planar array antenna configuration could be constructed, such as a circular-shaped antenna, and the antenna may be used in other than radar and communication systems.

What is claimed is:

1. A waveguide assembly employing a first plate (34) with a vertical structural member and a second plate (36) with a vertical structural member (37) for use in antenna arrays having half waveguides with a zero electrical current line along the center of the waveguide assembly comprising:

(a) said first plate consisting of a plurality of matching protruding equal-length members perpendicularly disposed to said structual member of said first plate (34) each said protruding member having two ends;

(b) said second plate (36) consisting of a plurality of protruding equal length members (41, 42, 43, 44) perpendicularly disposed to said structural member of said second plate (36) each said protruding member (41, 42, 43 44) having two ends;

(c) said first plate (34) in juxtaposition with said second plate (36) so that each of said ends of each of said plurality of matching protruding members in said first plate (34) is aligned with each of said ends of said corresponding plurality of matching said ends of said protruding members in said second plate (36) such that said zero electrical current line exists at the junction of each of said ends; and (d) means for holding said first plate (34) and said second plate (36) together.

2. The waveguide assembly of claim 1 wherein said means for holding said first metal plate (34) and said second plate (36) together is a bolting mechanism.

3. The waveguide assembly of claim 1 wherein said plurality of matching protruding members are equally spaced in said first plate (34) and said second plate (36).

4. The waveguide assembly of claim 1 wherein said first plate (34) and said second plate (36) are made of metal.

5. The waveguide assembly of claim 4 wherein said metal is aluminum.

6. The waveguide assembly of claim 4 wherein said metal is magnesium.

7. The waveguide assembly of claim 4 wherein said metal is copper.

8. The waveguide assembly of claim 4 wherein said metal is steel.

9. The waveguide assembly of claim 1 wherein said first plate (34) and said second plate (36) are made of metallized plastic.

10. An antenna array comprising a plurality of waveguide assemblies as defined by claim 1.

11. An antenna array as defined by claim 10 for use in radar systems.

12. An antenna array as defined in claim 10 for use in communication systems.

13. A close tolerance circular waveguide assembly employing a first plate (34) with a vertical structural member and a second plate (36) with a vertical structural member (37) for use in antenna arrays having half waveguides with a zero electrical current line along the center of the waveguide assembly comprising:

(a) said first plate consisting of a plurality of matching protruding equal-length members perpendicularly disposed to said structual member of said first plate (34) each said protruding member having two ends;

(b) said second plate (36) consisting of a plurality of protruding equal length members (41, 42, 43, 44) perpendicularly disposed to said.structural member of said second plate (36) each said protruding member (41, 42, 43 44) having two ends;

(c) said first plate (34) in juxtaposition with said second plate (36) so that each of said ends of each of said plurality of matching protruding members in said first plate (34) is aligned with each of said ends of said corresponding plurality of matching said ends of said protruding members in said second plate (36) such that said zero electrical current line exists at the junction of each of said ends; and (d) means for holding said first plate (34) and said second plate (36) together.

14. The close tolerance waveguide assembly of claim 13 wherein said means for holding said first metal plate (34) and said second plate (36) together is a bolting mechanism.

15. The close tolerance waveguide assembly of claim 13 wherein said plurality of matching protruding members are equally spaced in said first plate (34) and said second plate (36).

16. The close tolerance waveguide assembly of claim 13 wherein said first plate (34) and said second plate (36) are made of metal.

17. The waveguide assembly of claim 16 wherein said metal is aluminum.

18. The waveguide assembly of claim 16 wherein said metal is magnesium.

19. The waveguide assembly of claim 16 wherein said metal is copper.

20. The waveguide assembly of claim 16 wherein said metal is steel.

21. The waveguide assembly of claim 16 wherein said first plate (34) and said second plate (36) are made of metallized plastic.

22. An antenna array comprising a plurality of close tolerance waveguide assemblies as defined by claim 13.

23. An antenna array as defined by claim 22 for use in radar systems.

24. A close tolerance rectangular waveguide assembly employing a first plate (34) with a vertical structural member and a second plate (36) with a vertical structural member (37) for use in antenna arrays having half waveguides with a zero electrical current line along the center of the broadwall of the waveguide assembly comprising:

(a) said first plate consisting of a plurality of matching protruding equal-length members perpendicularly disposed to said structual member of said first plate (34) each said protruding member having two ends;

(b) said second plate (36) consisting of a plurality of protruding equal length members (41, 42, 43, 44) perpendicularly disposed to said structural member of said second plate (36) each said protruding member (41, 42, 43 44) having two ends;

(c) said first plate (34) in juxtaposition with said second plate (36) so that each of said ends of each of said plurality of matching protruding members in said first plate (34) is aligned with each of said ends of said corresponding plurality of matching said ends of said protruding members in said second plate (36) such that said zero electrical current line exists at the junction of each of said ends; and (d) means for holding said first plate (34) and said second plate (36) together.

25. The close tolerance waveguide assembly of claim 24 in said means for holding said first metal plate (34) and said second plate (36) together is a bolting mechanism.

26. The close tolerance waveguide assembly of claim 24 wherein each of said ends of said plurality of protruding interior waveguide members for first plate (34) and for said second plate (36) has a "T" shape, and each of said ends of the two protruding exterior waveguide members for first plate (34) and for second plate (36) has an "L" shape.

27. An antenna array comprising a plurality of close tolerance waveguide assemblies as defined by claim 26.

28. An antenna array as defined by claim 27 for use in radar systems.

29. The close tolerance waveguide assembly of claim 24 wherein said plurality of matching protruding members are equally spaced in said first plate (34) and said second plate (36).

30. The close tolerance waveguide assembly of claim 24 wherein said first plate (34) and said second plate (36) are made of metal.

31. The waveguide assembly of claim 30 wherein said metal is aluminum.

32. The waveguide assembly of claim 30 wherein said metal is magnesium.

33. The waveguide assembly of claim 30 wherein said metal is copper.

34. The waveguide assembly of claim 30 wherein said metal is steel.

35. The waveguide assembly of claim 24 wherein said first plate (34) and said second plate (36) are made of metallized plastic.

36. The waveguide assembly of claim 24 wherein the rectangular waveguide assembly is the shape of a square.

37. An antenna array comprising a plurality of close tolerance waveguide assemblies as defined by claim 24.

38. An antenna array as defined by claim 37 for use in radar systems.

39. A close tolerance waveguide assembly employing first (32), second (34) and third (36) plates, each said plate having a vertical structural member for use in antenna arrays having half-waveguides with zero electrical line along the center of the waveguide assembly comprising:

(a) said first (32), said second (34) and said third (36) plates, each said plate consisting of a plurality of matching protruding members perpendicularly disposed to said structural member of said respective plate, each said protruding member having two ends;

(b) said first plate (32) being combined with said second plate (34) so that each of said ends of each of said plurality of matching protruding members in said first plate (32) is aligned with each of said ends of each of said corresponding plurality of matching said ends of said protruding members in said second plate (34) such that said zero electrical current lines exist at the junctions of each of said ends;

(c) said second plate (34) being combined with said third plate (36) so that each of said ends of each of said plurality of matching protruding members in said second plate (34) is aligned with each of said ends of each of said corresponding plurality of matching said ends of said protruding members in said third plate (36) such that said zero electrical current lines exist at the junctions of each of said ends; and (d) means for holding said first plate (32), said second plate (34), and said third plate (36) together.

40. The close tolerance waveguide assembly of claim 39 wherein said means for holding said first plate (32), said second plate (34), and said third plate (36) together is a bolting mechanism.

41. The close tolerance waveguide assembly of claim 39 wherein said plurality of matching protruding members are equally spaced in first plate (32) said second plate (34), and said third plate (36).

42. The close tolerance waveguide assembly of claim 39 wherein said first plate (32) and said second plate (34), and said third plate (36) are made of metal.

43. The waveguide assembly of claim 42 wherein said metal is aluminum.

44. The waveguide assembly of claim 42 wherein said metal is magnesium.

45. The waveguide assembly of claim 42 wherein said metal is copper.

46. The waveguide assembly of claim 42 wherein said metal is steel.

47. The waveguide assembly of claim 30 wherein said first plate (32) and said second plate (34) and said third plate (36) are made of metallized plastic.

48. An antenna array comprising a plurality of close tolerance waveguide assemblies as defined by claim 39.

49. An antenna array as defined by claim 48 for use in radar systems.

50. An antenna array waveguide assembly having a first and a second half-waveguide with zero current line along the center of the waveguide comprising:

(a) said first half-waveguide (34) consisting of a plurality of equal-length members perpendicularly disposed at equal distance along a structural member of said first half-waveguide (34);

(b) said second (36) half-waveguide (36) consisting of a plurality of equal-length members perpendicularly disposed at equal distance along a structural member of said second half-waveguide (36);

(c) said first half-waveguide (34) in juxtaposition with said second half-waveguide (36) so that each end of said equal-length members of said first half-waveguide (34) is aligned with each end of said equal-length members of said second half-waveguide (36); and (d) means for holding said first half-waveguide (34) and said second half-waveguide (36) together, such that said zero current line is positioned along the center of the broadwall of said antenna array waveguide assembly formed by said first and said second half-waveguides.

51. An antenna array comprising a plurality of waveguide assemblies as defined by claim 50.

52. An antenna array as defined by claim 51 for use in radar systems.

* * * * *